US009930436B2

(12) United States Patent
Fukuda

(10) Patent No.: US 9,930,436 B2
(45) Date of Patent: Mar. 27, 2018

(54) BONE CONDUCTION SPEAKER

(71) Applicant: TEMCO JAPAN CO., LTD., Tokyo (JP)

(72) Inventor: Mikio Fukuda, Tokyo (JP)

(73) Assignee: TEMCO JAPAN CO., LTD. (JP)

( * ) Notice: Subject to any disclaimer, the term of this patent is extended or adjusted under 35 U.S.C. 154(b) by 0 days.

(21) Appl. No.: 14/907,588

(22) PCT Filed: Apr. 9, 2015

(86) PCT No.: PCT/JP2015/061079
§ 371 (c)(1),
(2) Date: Jan. 26, 2016

(87) PCT Pub. No.: WO2015/198683
PCT Pub. Date: Dec. 30, 2015

(65) Prior Publication Data

US 2017/0164088 A1 Jun. 8, 2017

(30) Foreign Application Priority Data

Jun. 26, 2014 (JP) ..... 2014-131066

(51) Int. Cl.
*H04R 1/10* (2006.01)
*H04R 25/00* (2006.01)
(Continued)

(52) U.S. Cl.
CPC ..... *H04R 1/1008* (2013.01); *H04R 1/1016* (2013.01); *H04R 1/46* (2013.01);
(Continued)

(58) Field of Classification Search
CPC ..... H04R 1/1008; H04R 1/1016; H04R 1/46; H04R 9/06; H04R 2460/13; H04R 25/00–25/75; H04R 1/023
See application file for complete search history.

(56) References Cited

U.S. PATENT DOCUMENTS 1,969,559 A * 8/1934 Kelly ..... H04R 25/60 381/151
3,139,545 A * 6/1964 Dreyfus ..... H01H 53/015 310/15
(Continued)

FOREIGN PATENT DOCUMENTS

WO WO2005096664 A1 10/2005

OTHER PUBLICATIONS

International Search Report; PCT/JP2015/061079; dated Apr. 9, 2015; 1 pg.

*Primary Examiner* — Mark Fischer
(74) *Attorney, Agent, or Firm* — Schmeiser, Olsen & Watts, LLP

(57) ABSTRACT

A bone conduction speaker is provided that, while it is a bone conduction speaker, additionally has a structure allowing a respiratory tract sound to be generated, thereby the high frequency characteristics thereof being improved. In the case where it is used by a hearing non-impaired person, communications at a good voice level can be made as well as in the case where it is used by a hearing impaired person. Further, when the hearing non-impaired person uses it to listen to a music, the music can be enjoyed with a high sound quality.

11 Claims, 5 Drawing Sheets

(51) Int. Cl.
*H04R 1/46* (2006.01)
*H04R 9/06* (2006.01)

(52) U.S. Cl.
CPC ..... *H04R 9/06* (2013.01); *H04R 25/48* (2013.01); *H04R 2460/13* (2013.01)

(56) References Cited

U.S. PATENT DOCUMENTS

| | | | | |
|---|---|---|---|---|
| 2006/0262954 | A1* | 11/2006 | Lee | H04M 1/03 381/380 |
| 2007/0104340 | A1* | 5/2007 | Miller | H04R 31/006 381/182 |
| 2007/0160238 | A1 | 7/2007 | Kobayashi | |
| 2012/0237065 | A1* | 9/2012 | Higgins | H04R 25/65 381/322 |
| 2016/0191097 | A1* | 6/2016 | Huh | H04R 1/345 455/575.1 |

* cited by examiner

BONE CONDUCTION SPEAKER

CROSS-REFERENCE TO RELATED APPLICATIONS

This application claims priority to PCT Application No. PCT/JP2015/061079, having a filing date of Apr. 9, 2015, based on JP 2014-131066, having a filing date of Jun. 26, 2014, the entire contents both of which are hereby incorporated by reference.

FIELD OF TECHNOLOGY

The following relates to a bone conduction speaker, and more particularly, relates to a bone conduction speaker which, in consideration of that it may be used by a hearing non-impaired person, allows generation of not only a bone conduction sound, but also a respiratory tract sound.

BACKGROUND

The bone conduction speaker generally has a structure with which a vibrating surface of a vibrating member of the bone conduction speaker unit is abutted against an internal surface of a housing, being fixed thereto, thereby the entire housing being vibrated, and the general way of using it is to apply a vibrating surface of the housing to the nipple-like protruded portion, or the like, of an ear (see FIG. 9).

The bone conductive speaker has been developed to provide a hearing support for a conductive hearing-impaired person, however, besides the original application therefor, there is an example of use in which a hearing non-impaired person disposes a bone conduction speaker in the vicinity of a tragus as a means for listening to audio information without plugging up the ear hole. However, in the latter case of usage, there is no problem for communications at a voice level, but the transmission characteristics of bone vibration involves a great attenuation at a high-area side, and thus in listening to music, it is difficult to raise the sound quality of the music.

Disclosure of the Invention

As described above, in the case where a hearing non-impaired person uses a bone conduction speaker, there has been a problem that the transmission characteristics of bone vibration involves a great attenuation at a high-area side, and thus in listening to a music, it is difficult to raise the sound quality of the music.

SUMMARY

An aspect relates to a bone conduction speaker that, while it is a bone conduction speaker, additionally has a structure allowing a respiratory tract sound to be generated, thereby the high frequency characteristics thereof being improved, and thus, that, in the case where it is used by a hearing non-impaired person, communications at a good voice level can be made as well as in the case where it is used by a hearing impaired person, and further, when the hearing non-impaired person uses it to listen to a music, the music can be enjoyed with a high sound quality.

Means for Solving the Problem(s)

To solve the above problem a bone conduction speaker is provided including a housing, a bone conduction speaker unit, and a second diaphragm, the second diaphragm being incorporated in the housing, and the second diaphragm being fixed to a bottom face of the bone conduction speaker unit, a peripheral part of the second diaphragm being fixed to an inner surface of the housing over its entire periphery, thereby an upper air chamber being formed on the upper side of the second diaphragm, and a lower air chamber being formed on the lower side thereof, and a sound emitting port being formed in a side face or a bottom face of the lower air chamber.

In one embodiment, the second diaphragm has an annular groove and/or an annular convex part in the peripheral part.

In another embodiment, in the central part of the second diaphragm, there is formed a circular base part for securing a gap with respect to the bottom face of the bone conduction speaker unit, the circular base part being fixed to the bottom face of the bone conduction speaker unit. Or, in the central part of the second diaphragm, a weight for improving the frequency characteristics is fixedly attached to the central part of the second diaphragm, the weight securing a gap between the second diaphragm and the bottom face of the bone conduction speaker unit, or, the bottom face of the bone conduction speaker unit is provided with a convex part, the convex part securing a gap between the second diaphragm and the bottom face of the bone conduction speaker unit.

In addition, in another embodiment, the housing has a low cylindrical shape, the sound emitting port being formed in a peripheral side face or a bottom face of the housing, and in another embodiment, the housing has a cylindrical shape at least one end of which is provided with a spherical surface, the sound emitting port being formed in the spherical surface.

Further, in another embodiment, the sound emitting port is provided with a sound conduction tube that is formed, being bent so as to be directed to the inside of an ear hole in service. The sound conduction tube is molded integrally with the housing, or the sound conduction tube is molded separately from the housing, and posteriorly attached to the sound emitting port. In addition, in another embodiment, the sound emitting port is made capable of being opened and closed.

Advantages

As described above, the bone conduction earphone in accordance with embodiments of the present invention is provided with a configuration in which the inside of the housing is partitioned in a vertical direction by a second diaphragm fixed to a bottom face of the bone conduction speaker unit, and a sound emitting port is formed in a side face or bottom face of the lower air chamber under the second diaphragm, thereby having the function capable of generating a respiratory tract sound from a sound emitting port in addition to the inherent function as a bone conduction speaker. Thus, the bone conduction earphone in accordance with embodiments of the present invention provides an advantage that, in the case where it is used by a hearing non-impaired person, communications at a good voice level can be made as well as in the case where it is used by a hearing impaired person, and further, when the hearing non-impaired person uses it to listen to a music, the music can be enjoyed with a high sound quality.

BRIEF DESCRIPTION

Some of the embodiments will be described in detail, with reference to the following figures, wherein like designations denote like members, wherein:

FIG. 1 is a longitudinal sectional view of a bone conduction speaker according to one embodiment of the present invention;

FIGS. 2(A) and 2(B) are perspective views showing examples of geometry of a housing for the bone conduction speaker;

Figure 6:
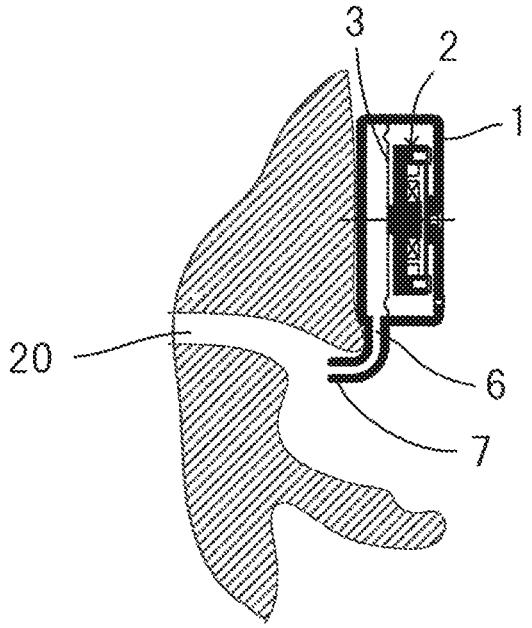
Figure 7:
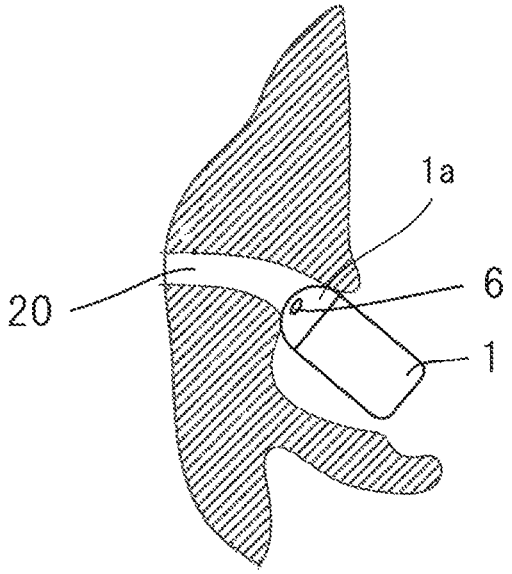
Figure 8:
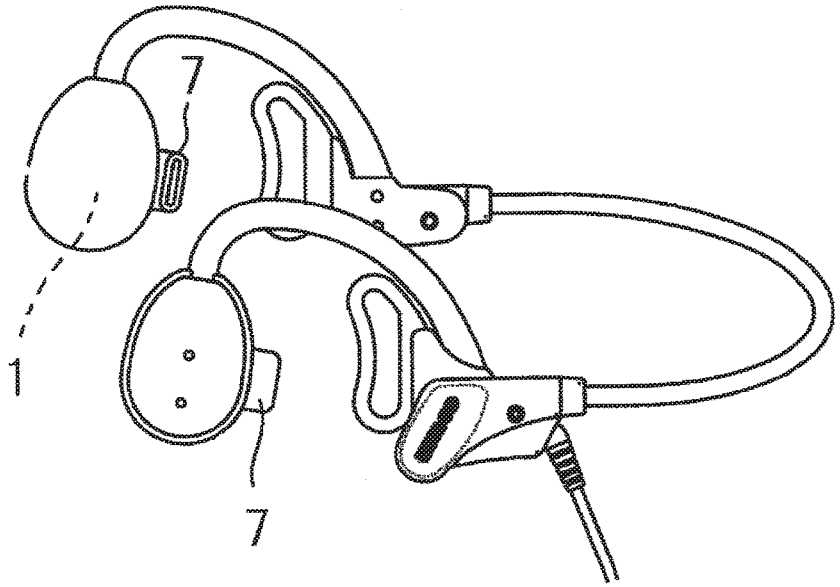
Figure 9:
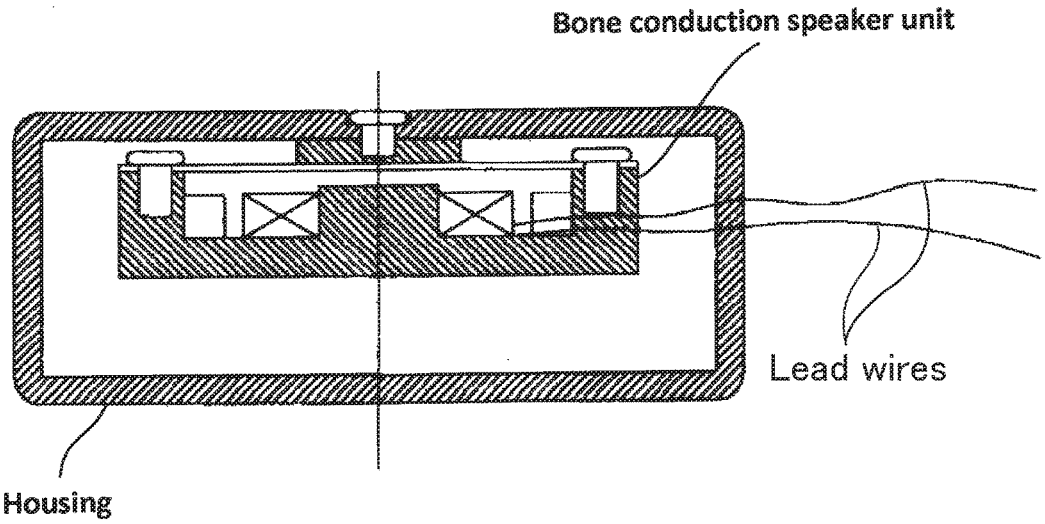

FIGS. 5(A) and 5(B) are respectively a perspective view and a longitudinal sectional view showing a geometry of a second diaphragm for the bone conduction speaker;

FIG. 6 is a longitudinal sectional view showing a state of use of the bone conduction speaker;

FIG. 7 is a longitudinal sectional view showing another state of use of the bone conduction speaker;

FIG. 8 is a longitudinal sectional view showing still another state of use of the bone conduction speaker; and FIG. 9 is a longitudinal sectional view showing a configuration of a conventional bone conduction speaker.

DETAILED DESCRIPTION

Hereinbelow, an embodiment of the present invention will be explained with reference to the attached drawings.

Figure 1:
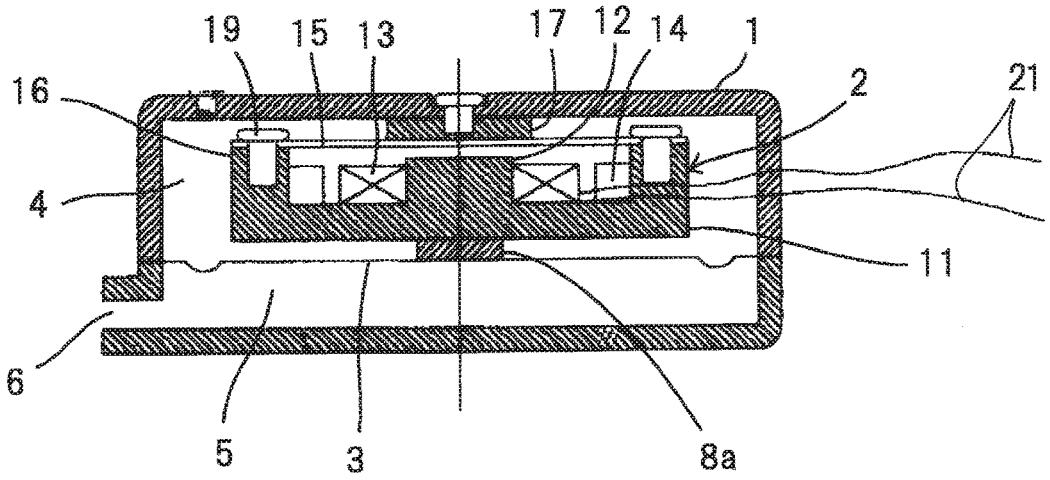

FIG. 1 is a longitudinal sectional view of a bone conduction speaker according to one embodiment of the present invention, and as shown in the same figure, the bone conduction speaker includes a housing 1; a bone conduction speaker unit 2 incorporated in the housing 1; and a second diaphragm 3 fixed on a bottom face of the bone conduction speaker unit 2. In addition, with a peripheral part of the second diaphragm 3 being fixed to an inner surface of the housing 1 over its entire periphery, an upper air chamber 4 is formed on the upper side of the second diaphragm 3, while, on the lower side of the second diaphragm 3, a lower air chamber 5 is formed, and in a side face or bottom face of the lower air chamber 5, a sound emitting port 6 that opens toward the outside is formed.

Figure 3:
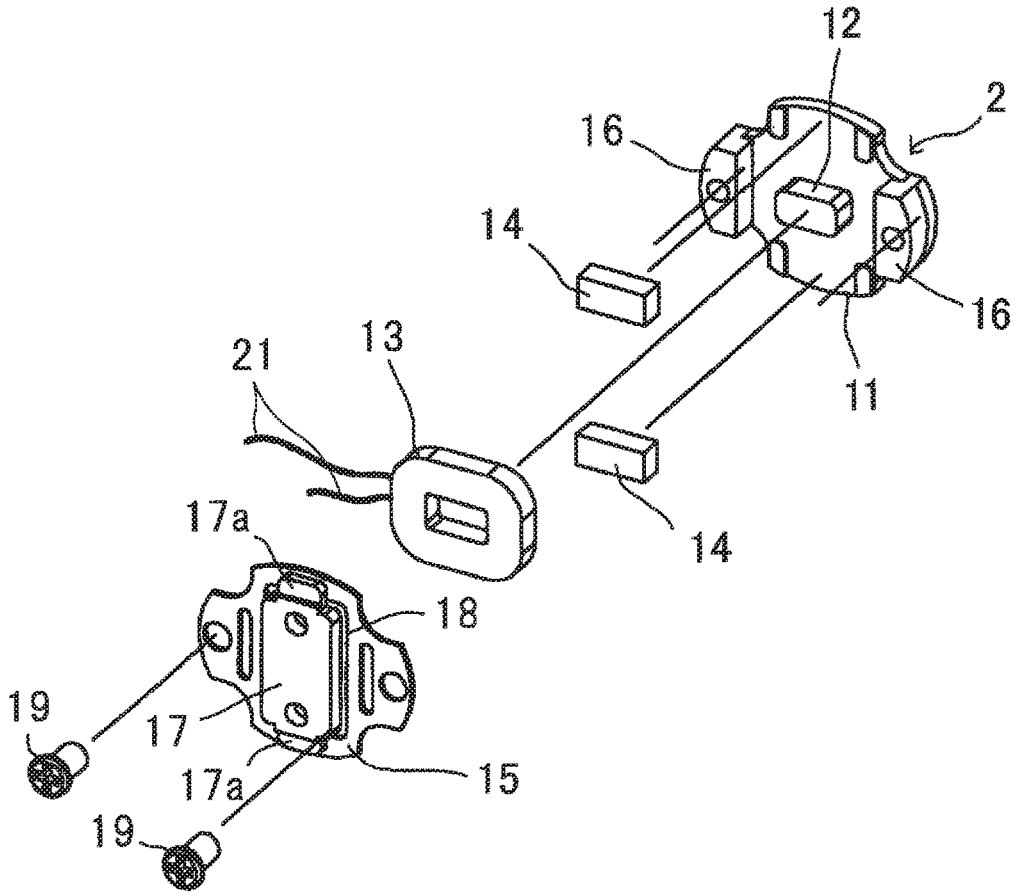
FIG. 3 is an exploded perspective view showing an example configuration of a bone conduction speaker unit for the bone conduction speaker.

The bone conduction speaker unit 2 used in embodiments of the present invention is configured as shown in, for example, FIG. 3, with a voice coil 13 being disposed so as to surround a center pole 12 provided in the central portion of a yoke 11, a pair of bar-like magnets 14, 14 being fixed to both sides of the voice coil 13, and a diaphragm 15 being disposed so as to cover the voice coil 13 and the magnets 14, 14. Both end parts of the diaphragm 15 are fixed, through set screws 20, or the like, to the top face of side walls 16 that are erected on both end parts of the yoke 11. At that time, a gap is provided between the diaphragm 15 and the top face of the voice coil 13.

In the diaphragm 15, an opening 18 that is oblong and has a size corresponding to the size of a plate yoke 17 is formed, and the plate yoke 17 is disposed on the opening 18, being positioned so as to longitudinally straddle it, with both end parts 17*a* in a longitudinal direction of the plate yoke 17 being fixed to the edge parts of the opening 18. Thus, the plate yoke 17 is integrally vibrated along with the vibration of the diaphragm 15. From the voice coil 13, lead wires 21 are extending.

Figure 4:
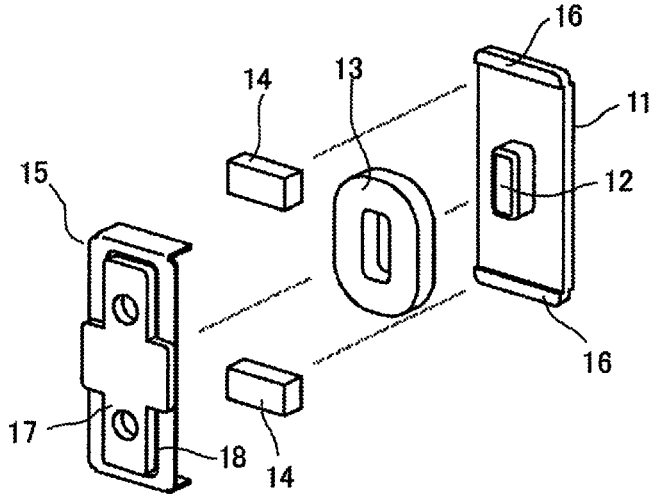
FIG. 4 is an exploded perspective view showing another example configuration of the bone conduction speaker unit for the bone conduction speaker.

Further, FIG. 4 is an exploded perspective view showing a configuration of the bone conduction speaker unit 2 of another aspect, and with the bone conduction speaker unit 2, the yoke 11 and the central magnetic pole 12 are formed vertically long, the magnets 14, 14 being disposed on the end parts on the shorter sides of the yoke 11 on both sides thereof, and on the outside of the respective magnets 14, 14, the diaphragm fixing part 16 being formed. The diaphragm 15 and the plate yoke 17 are also formed vertically long, and wing parts 17*b* are provided in an extended manner in the middle portion of the plate yoke 17. With the wing parts 17*b* being fixed to an edge part of a vertically long opening 18 provided in the diaphragm 15, the plate yoke 17 is disposed on the opening 18. Further, both end parts of the diaphragm 15 are directly fixed to the diaphragm fixing part 16. Thus, the plate yoke 17 is integrally vibrated together with the vibration of the diaphragm 15.

Either of the bone conduction speaker units 2 of the above-mentioned two aspects provides a so-called outer shell configuration, in which the magnets 14, 14 are disposed outside of the voice coil 13, however, contrarily to such configuration, a so-called inner shell configuration, in which the magnet 14 (also serving as the center pole) is disposed inside the voice coil 13, may be provided.

The geometry of the housing 1 corresponds to the geometry of the above-mentioned bone conduction speaker unit 2. For example, the bone conduction speaker unit 2 having a configuration shown in FIG. 3 is of a circular shape in plan view, the housing 1 in that case will be of a cylindrical shape (see FIG. 2(A)), the sound emitting port 6 being generally formed in the peripheral side face of the housing 1. In addition, in a preferred embodiment, in the sound emitting port 6, there is disposed a sound conduction tube 7 that is formed, being bent so as to be directed toward an ear hole 20 in service (see FIG. 6). The sound conduction tube 7 is molded integrally with the housing 1, or is molded separately from the housing 1, and posteriorly attached to the sound emitting port 6. In addition, the sound emitting port 6 is made capable of being opened and closed by means of a plug.

Figure 2:
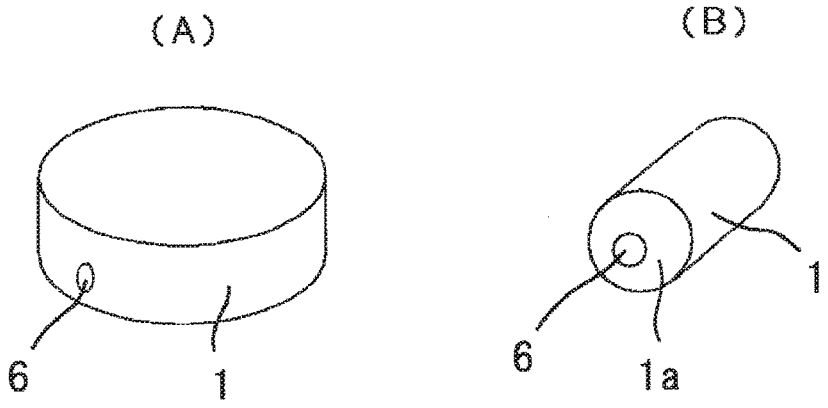

In addition, the bone conduction speaker unit 2 having a configuration shown in FIG. 4 is of a rectangular shape in plan view, and thus the housing 1 in that case will be lengthy, being of, for example, a cylindrical shape with at least one end part thereof being formed in a spherical surface (see FIG. 2 (B)). Further, the sound emitting port 6 in that case is formed in a spherical surface part 1*a* at one end (see FIG. 7).

The second diaphragm 3 functions in the same manner as a diaphragm used in a dynamic speaker, being formed in a circular shape by molding such a material as a plastic film, a polyester one, a thin metallic plate, or rubber, and the entire peripheral edge thereof is fixed to the inner peripheral surface of the housing 1. Preferably, the second diaphragm 3 has a geometry in which an annular groove 9 and/or and an annular convex part are formed in the edge part (see FIG. 5). The reason why such a geometry is provided is to improve the frequency characteristics, however, so long as the frequency characteristics are secured, a flat plate may, of course, be used.

Figure 5:
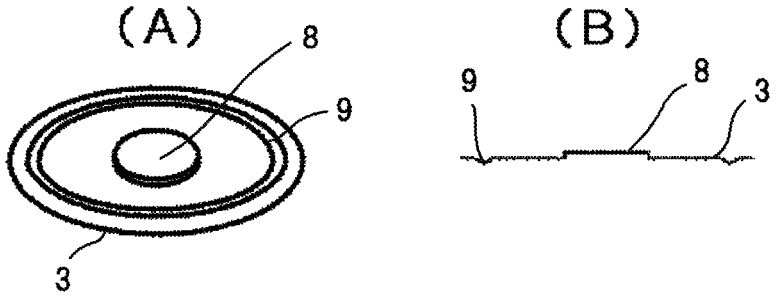

In the central part of the second diaphragm 3, there is formed a circular base part 8 to secure a gap with respect to the bone conduction speaker unit 2, i.e., the bottom face of the yoke 11, the circular base part 8 being fixed to the bottom face of the yoke 11 (see FIG. 5). Alternatively to providing this circular base part 8, a coin-like weight 8*a* made of a metal, a plastic material, or the like, for improving the frequency characteristics may be fixedly attached to the central part of the second diaphragm 3, a film being doubly disposed therearound, thereby the above-mentioned gap being secured with the weight 8*a* (see FIG. 1). Or, a convex part for fixing the second diaphragm 3 may be provided on the bottom face of the yoke 11 in order to secure the above-mentioned gap.

Since the bone conduction speaker in accordance with embodiments of the present invention is configured as above, the bone conduction speaker unit 2 is vibrated upon reception of a voice signal, whereby bone vibration transmission can be performed through the housing 1. In addition, at that time, the second diaphragm 3 fixed on the bottom face of the bone conduction speaker unit 2 is vibrated together, however, the inside of the housing 1 is partitioned in a vertical direction by the second diaphragm 3, and any sound pressure generated in the lower air chamber 5 is released from the sound emitting port 6.

Here is an explanation of how to use the bone conduction speaker configured as above. In the case of a bone conduction speaker having the housing 1 shown in FIG. 2(A), the bone conduction speaker is used, being incorporated in, for example, a head set as shown in FIG. 8 that is loaded in such a way that the bottom face of the housing 1 is abutted against an area in the vicinity of the tragus. In the case where a hearing impaired person uses it, there is no need for generating a respiratory tract sound, and thus the sound emitting port 6 is blocked by plugging it up, or by other means, whereby sound leakage to the surroundings can be prevented.

On the other hand, in the case where a hearing non-impaired person uses it, the bone conduction speaker is disposed in the vicinity of the tragus with the sound emitting port 6 being directed to the ear hole for listening to a respiratory tract sound from the sound emitting port 6. When the sound emitting port 6 is provided with the sound conduction tube 7, the distal end of the sound conduction tube 7 is directed to the inside of the ear hole 20. Thus, the high frequency components that cannot be transmitted by bone conduction can be directly transmitted to the eardrum as a respiratory tract sound, whereby a high quality sound can be listened to.

Further, in the case of a bone conduction speaker having the housing 1 shown in FIG. 2(B), the bone conduction speaker can be configured as an extremely compact unit, whereby it can be used as an earphone type unit as shown in FIG. 7. The ways of using it by a hearing impaired person and a hearing non-impaired person are the same as those described above.

Hereinabove, embodiments of the present invention have been explained in detail to some extent and about the most preferred embodiment, however, since it is obvious that a wide range of different embodiments can be made without departing from the spirit and scope of embodiments of the present invention, it is to be understood that embodiments of the present invention is not limited to the specific embodiments thereof except as defined in the claims.

DESCRIPTION OF SYMBOLS

Reference numeral 1 denotes a housing; 2 a bone conduction speaker unit; 3 a second diaphragm; 4 an upper air chamber; 5 a lower air chamber; 6 a sound emitting port; 7 a sound conduction hole; 8 a circular base part; 8*a* a weight; 9 an annular groove; 11 a yoke; 12 a central magnetic pole; 13 a voice coil; 14 a magnet; 15 a diaphragm; 16 a diaphragm fixing part; 17 a plate yoke; 18 an opening; 19 a setscrew; and 20 an ear hole.

The invention claimed is:

1. A bone conduction speaker comprising:

a bone conduction speaker unit in a housing thereof, the bone conduction speaker unit comprising a voice coil disposed so as to surround a center pole provided in a central portion of a yoke;

a pair of bar magnets fixed to opposite sides of the voice coil;

a first diaphragm disposed so as to cover the voice coil and the pair of bar-like magnets, the first diaphragm being fixed to an inner surface of the housing, thereby a force of inertia generated by vibration of the yoke causing the housing to be vibrated;

a second diaphragm, the second diaphragm being fixed to a bottom face of the bone conduction speaker unit, a peripheral part of the second diaphragm being fixed to the inner surface of the housing over an entire periphery of the peripheral part, thereby an upper air chamber being formed on an upper side of the second diaphragm, and a lower air chamber being formed on a lower side thereof; and a sound emitting port being formed in a side face or a bottom face of the lower air chamber.

2. The bone conduction speaker according to claim 1, wherein the second diaphragm has an annular groove and/or an annular convex part in the peripheral part.

3. The bone conduction speaker according to claim 1, wherein in the central part of the second diaphragm, there is formed a circular base part for securing a gap with respect to the bottom face of the bone conduction speaker unit, the circular base part being fixed to the bottom face of the bone conduction speaker unit.

4. The bone conduction speaker according to claim 1, wherein in the central part of the second diaphragm, a weight for improving the frequency characteristics is fixedly attached to the central part of the second diaphragm, the weight securing a gap between the second diaphragm and the bottom face of the bone conduction speaker unit.

5. The bone conduction speaker according to claim 1, wherein the bottom face of the bone conduction speaker unit is provided with a convex part, the convex part securing a gap between the second diaphragm and the bottom face of the bone conduction speaker unit.

6. The bone conduction speaker according to claim 1, wherein the sound emitting port is made capable of being opened and closed.

7. The bone conduction speaker according to claim 1, wherein the housing has a low cylindrical shape, the sound emitting port being formed in a peripheral side face or a bottom face of the housing.

8. The bone conduction speaker according to claim 1, wherein the housing has a cylindrical shape at least one end of which is provided with a spherical surface, the sound emitting port being formed in the spherical surface.

9. The bone conduction speaker according to claim 7, wherein the sound emitting port is provided with a sound conduction tube that is formed, being bent so as to be directed to the inside of an ear hole in service.

10. The bone conduction speaker according to claim 9, wherein the sound conduction tube is molded integrally with the housing.

11. The bone conduction speaker according to claim 9, wherein the sound conduction tube is molded separately from the housing, and posteriorly attached to the sound emitting port.

* * * * *